United States Patent [19]

Martin

[11] Patent Number: 5,070,232

[45] Date of Patent: Dec. 3, 1991

[54] OPTICAL COATING PYROLIZER

[75] Inventor: David A. Martin, Northridge, Calif.

[73] Assignee: Lockheed Corporation, Calabasas, Calif.

[21] Appl. No.: 454,799

[22] Filed: Dec. 21, 1989

[51] Int. Cl.[5] ..... F27B 5/14; F27D 11/00

[52] U.S. Cl. ..... 219/390; 219/521

[58] Field of Search ..... 219/390, 10.45, 385, 219/521, 386; 73/826; 374/49

[56] References Cited

U.S. PATENT DOCUMENTS

| | | | |
|---|---|---|---|
| 3,374,117 | 3/1968 | Savage | 219/521 |
| 3,474,517 | 10/1969 | Menne | 219/521 |
| 3,972,682 | 8/1976 | Stephen et al. | 219/390 |
| 4,020,080 | 6/1977 | DiVita et al. | 65/2 |

*Primary Examiner*—Teresa J. Walberg
*Assistant Examiner*—Tuan Vinh To

[57] ABSTRACT

The invention is an apparatus for removing a coating from a fiber optic cable. The apparatus includes a support member. A heating coil, having first and second ends, is mounted to the stand, with the first end of the coil adapted to receive the fiber optic cable within the interior thereof. A container is mounted within the coil, the container having first and second closed off ends in proximity to the first and second ends of the coil, respectively, the first end of the container having an aperture for receiving the fiber optic cable. A power controller is electrically coupled to the heating coil for controlling the temperature thereof. A vacuum system is inlcuded for removing fumes from within the container produced when a coating is pyrolized.

6 Claims, 1 Drawing Sheet

OPTICAL COATING PYROLIZER

BACKGROUND OF THE INVENTION

1. Field of the Invention

The invention relates to the field of fiber optic cables and, in particular, to a method of removing coatings therefrom.

2. Description of Related Art

Fiber optic cables, typically comprise a central glass core with an outer layer of cladding, a protective organic coating bonded thereto and a nonbonded flexible rubber like cover thereover. In connecting such fiber optic cables to other cables, or devices, etc., the cable must be precisely aligned within the connective element. However, the cover and protective coating do not have precise dimensional tolerances, and thus must be removed prior to making the connection. While the cover is easily removed, the protective coating thereunder is bonded to the cladding and is difficult to remove. One of the most common methods for removing this protective coating is to vaporize the coating by passing the cable through a flame. However, if the temperature of the flame is uncontrolled, damage to the core and cladding can occur. Also, the non-uniform heating may leave portions of the protective coating on the cladding layer. Additionally, the gases produced when vaporizing the protective coating may be dangerous if continuously inhaled. Additionally, it is a time consuming process and requires considerable experience to properly remove the protective coating in a timely fashion. Acid dips have been used but have also provided unsatisfactory results.

Also of interest is U.S. Pat. No. 4,020,080 "Methods of Treating Optical Wave Fibers" by S. DiVita et al. which discloses a method of removing impurities from the surface of a fiber by passing it through an ultraviolet light source in an oxygen enriched environment at high temperature. However, it is not applicable to the removing of a complete organic coating, but only small amounts of impurities deposited on the surface of the cladding during the forming thereof. In fact, it is designed for use prior to the application of the protective coating.

Thus, it is a primary object of the subject invention to provide an apparatus for removing protective coatings from a fiber optic cable.

It is another object of the subject invention to provide an apparatus for removing protective coatings from a fiber optic cable by the uniform application of heat to vaporize the protective coating.

It is a further object of the subject invention to provide an apparatus for removing protective coatings from a fiber optic cable by the application of heat to vaporize the protective coating and to further collect and dispose of any of the vapors generated during the process.

SUMMARY OF THE INVENTION

The invention is an apparatus for removing coatings from fiber optic cables. In summary, the invention includes a support member. A heating coil having first and second ends is mounted to the support member, the first end of the coil for receiving the fiber optic cable within the interior thereof. A power controller is electrically coupled to the coil for controlling the temperature thereof.

In more detail, the pyrolizer apparatus includes a controller and a pyrolizer housing supported by a frame member mounted to the controller. Mounted within the housing is an outer closed off first cylindrical container having a side wall and lower and upper covers with the lower cover attached to a flange mounted to and extending from the back wall of the housing. The outer container includes an aperture extending through the bottom cover. An inner, smaller cylindrical container is mounted within the larger container having an open ends in contact with the bottom cover of the outer container. Mounted about the side wall of the inner container is a heating coil preferably in contact therewith and having a length generally equal to the length of the inner container. The coil is connected by a wire harness to the controller. The controller is conventional in nature in that the temperature can be set by a dial assembly and an indicator light illuminates when the coil has reached the preset temperature.

Also mounted between the side walls of the inner and outer containers is a layer of flexible high temperature insulation 78. Thus, when the coil is activated, the inner container holds the heated air therein and the insulation and outer container reduce heat transfer loss from the coil.

A guide member in the form of a hollow tube extends from the bottom wall of the housing and into the bottom cover of the outer container and, thus, provides a guide for the cable from the exterior of the housing to the interior of the inner container. A vacuum pumping system is coupled to the hollow tube to draw of any harmful gases generated when vaporizing the protective coating.

To use the pyrolizer apparatus one must first strip the outer cover from the end of the fiber optic cable exposing the protective layer. The fiber optic cable is then inserted into the hollow tube such that it is approximately ⅛ inch from the top surface of the inner container. Thereafter, the coil is actuated (if not already at temperature) by adjusting the dial and waiting until the illumination of the light. A typical exposure time is 30 seconds.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

Illustrated in FIG. 1 is a perspective view of the end of a fiber optic cable.

Illustrated in FIG. 2, is a front view of the pyrolizer apparatus with the front wall removed and, in addition, partially broken away to show the interior of the pyrolizer apparatus.

DESCRIPTION OF THE PREFERRED EMBODIMENT

Figure 1:
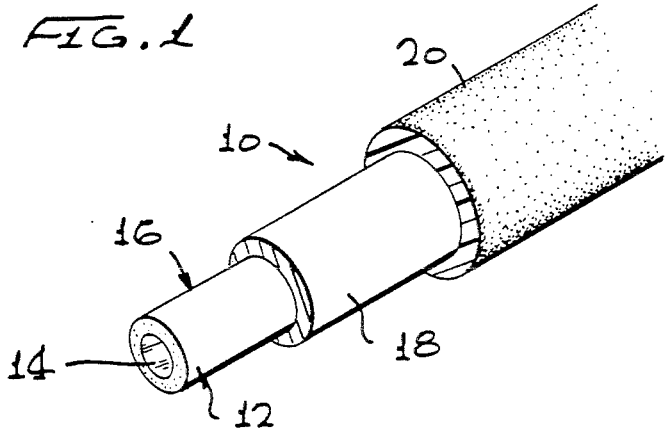

Illustrated in FIG. 1 is a perspective view of an end portion of a typical fiber optic cable, generally indicated by numeral 10. The cable 10 is composed of a light transmitting optical fiber 12 consisting of a central glass core 14 and an integral light transmitting outer cladding or layer 16. The outer layer 16 typically has a higher index of refraction so that scattered light from the core 12 is refracted back there within. Bonded about the layer 16 is a protective organic coating 18, such as a polyimide. It is this coating that must be removed if efficient light transmitting joints are to be obtained. The outer protective cover 20 usually consists of an unbonded rubber like material that is easily removed.

Figure 2:
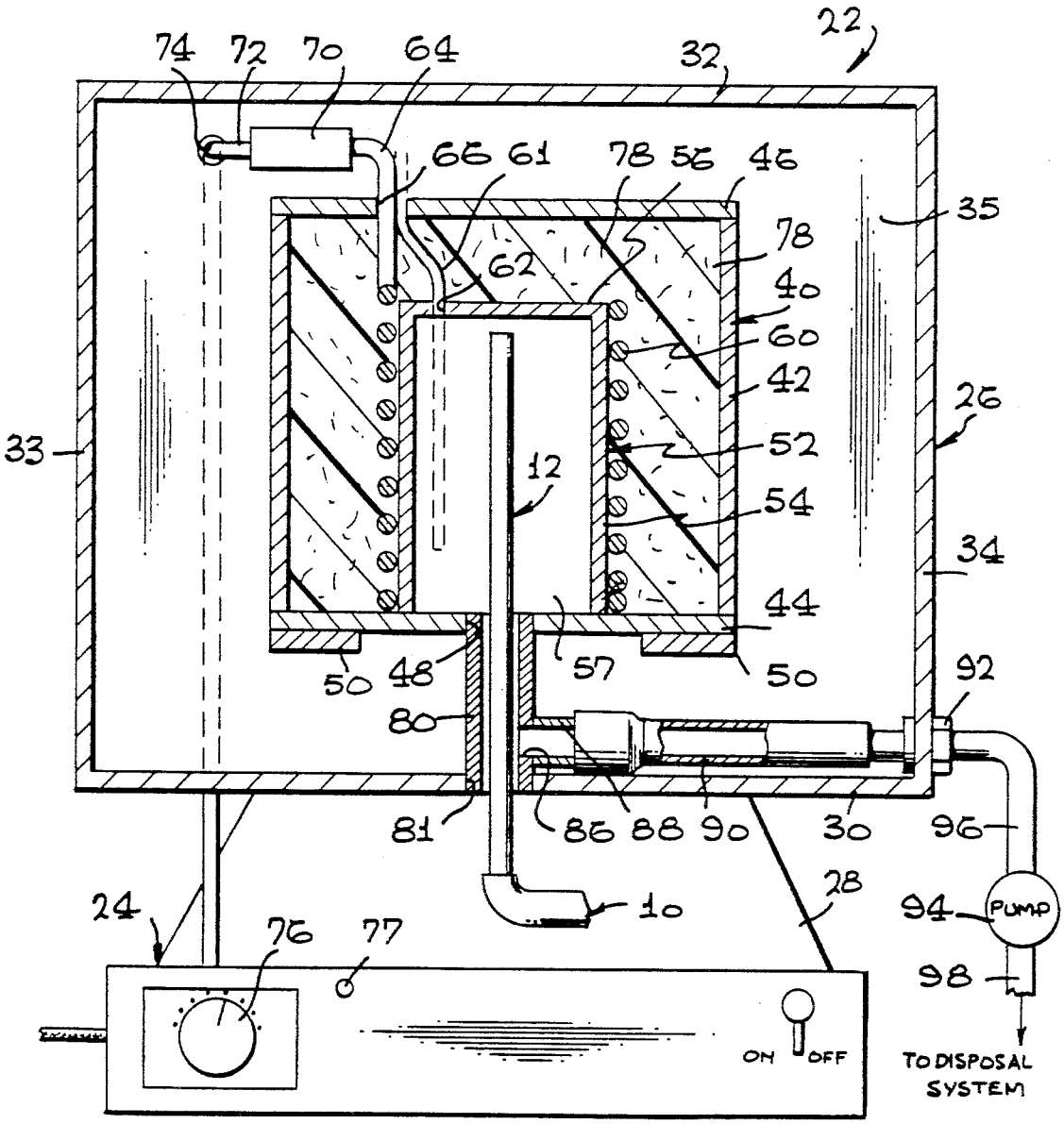

Illustrated in FIG. 2 is a front view of a pyrolizer apparatus, generally indicated by numeral 22, comprising a controller 24, and a pyrolizer housing 26 supported by a stand 28 mounted to the controller. The housing 26 includes bottom and top walls 30 and 32, left and right side walls 33 and 34 and a back wall 35. A removable front wall is also provided, but is not shown for purposes of illustrating the interior of the housing 26. Mounted within the housing 26 is an outer closed off cylindrical container 40 having a side wall 42 and lower and upper covers 44 and 46, respectively, with the lower cover 44 attached to flanges 50 mounted to and extending from the back wall 35. The outer container 40 further includes an aperture 48 in the bottom cover 44. An inner, smaller cylindrical container 52 is mounted within the container 40, and includes a side wall 54, a top cover 56 and an open bottom end 57.

A heating coil 60 is mounted about side wall 54 of the inner container 52, preferably in contact therewith and having a length generally equal to the length of the container 52. Such heating coils are commercially available, for example, a close wound MIGHTY-BAND COIL manufactured by Tempco Electric Heating Corporation, Orange, California. These coils are capable of producing temperatures in excess of 1,000° F., more than sufficient to remove any organic coating. [Such coils also incorporate an integral thermocouple (not shown) so that coil temperature can be monitored.] Alternately, a separate thermocouple 61, shown in dotted lines, can be installed directly into container 52 exiting out upper cover 56 via hole 62. The coil 60 has an end portion 64 extending out the top cover 46 of the container 40 via a hole 66 and terminates in a connector 70. A conventional wire harness 72, which includes power and thermocouple wires, is coupled to the connector 70 and exits the housing 26 via a hole 74 in the back wall 35 and connects to controller 24. If a separate thermocouple 61 is used it can follow the same path as coil 60 to connect to controller 24. The controller 24 is conventional in nature in that the temperature can be set by a dial assembly 76 and an indicator light 77 illuminates when the coil 60 has reached the set temperature.

Also mounted between the side walls 42 and 54 of the containers 40 and 52, respectively, is a layer of flexible high temperature insulation, indicated by numeral 78. Thus, when the coil 60 is activated, the inner container 52 holds the heated air therein, and the insulation 78 and outer container 40 reduce heat transfer loss from the coil.

A hollow tube 80 extends from an aperture 81 in the bottom wall 30 of the housing 26 and into the aperture 48 in the bottom cover 44 of the container 40, and thus, provides a guide for the fiber optic cable 10 from the exterior of housing 26 to the center of the interior of the container 52. An aperture 86 is provided in the tube 80 near the bottom wall 30, to which is joined a fitting 88. A hollow flexible tube 90 connects the fitting 88 to a second fitting 92 mounted to the side wall 34. The fitting 92, in turn, is coupled to a vacuum pump 94 via a tube 96, the outlet line 98 cf the pump 94 being coupled to a suitable disposing system (not shown). This insures that any harmful gases generated when vaporizing the coating 18 on the fiber optic cable 10 can safely be disposed of.

Referring to FIGS. 1-2, it can be seen that to use the pyrolizer apparatus 22, one must first strip the cover 20 from the end of the fiber optic cable 10, exposing the protective layer 18. The fiber optic cable 20 is inserted through the tube 80 such that it is approximately ⅛ inch from the top cover 56, of the inner container 52. This is best accomplished by inserting the cable 20 until it contacts cover 56 and then backing off ⅛ of an inch. Thereafter, the coil 60 can be actuated (if not already at temperature) by adjusting the dial 76 and waiting until illumination of the light 79. A typical exposure time is 30 seconds; the vaporized coating is drawn off by the vacuum pump 95.

It must be noted that the inner and outer containers 52 and 40 and insulation 78 and the means to draw off the vaporized coating, etc., are not absolutely necessary. In fact, the pyrolizer apparatus will work having only a support member, the heating coil and controller. However, these additional features enhance the operation of the apparatus.

While the invention has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

INDUSTRIAL APPLICABILITY

The invention has applicability to the fiber optic cable industry and industries using fiber optic cables.

I claim:

1. An apparatus for removing a coating from a fiber optic cable comprising:

a support member;

a heating coil having first and second ends and a specific total length mounted to said support member, said first end of said coil for receiving the fiber optic cable within the interior thereof;

a first hollow container mounted within said coil, said first container having first and second closed off ends in proximity to said first and second ends of said coil seal off the coil from the interior of said coil, respectively, said first end of said container having an aperture for receiving the fiber optic cable;

a power controller electrically coupled to said heating coil, said controller for controlling the temperature of said coil; and vacuum means coupled to said container for removing fumes from said interior of said container when a coating is pyrolized.

2. The apparatus as set forth in claim 1 further including a hollow tubular fiber optic cable guide member mounted to said support member, said guide member having one end in communication with the center of said one end of said coil, such that a fiber optic cable can be inserted from the other end of said guide member and into the center of said coil.

3. The apparatus as set forth in claim 2, further including temperature sensing means to monitor the temperature of the interior of the coil.

4. The apparatus as set forth in claim 3, including said coil in contact with said first container.

5. The apparatus as set forth in claim 4, including a layer of insulation mounted about said coil.

6. The apparatus as set forth in claim 5, further comprising:

a second container mounted about said first container; and said layer of insulation mounted between said containers.

* * * * *